United States Patent [19]

Leblanc

[11] 4,000,810

[45] Jan. 4, 1977

[54] CASE FOR CLIP-ON SUNGLASSES

[75] Inventor: Conrad L. Leblanc, Leominster, Mass.

[73] Assignee: Foster Grant Co., Inc., Leominster, Mass.

[22] Filed: Oct. 3, 1975

[21] Appl. No.: 619,430

[52] U.S. Cl. ..... 206/5; D57/1 C; D16/82

[51] Int. Cl.[2] ..... A45C 11/04

[58] Field of Search ..... D9/192–193; D57/1 B, 1 C, 1 D; 206/5–6, 45.14, 45.34, 349, 525, 527; 220/1 R, 82; 224/.5, 5 V, 29 A; 229/2.5; 248/DIG. 2; 312/350, 352

[56] References Cited

UNITED STATES PATENTS

| | | | |
|---|---|---|---|
| 993,404 | 5/1911 | Price | 248/DIG. 2 |
| 2,380,297 | 7/1945 | Dibert | 248/DIG. 2 |
| 2,623,722 | 12/1952 | Glunt et al. | 248/DIG. 2 |
| 2,826,387 | 3/1958 | Rutten | 248/DIG. 2 |
| D152,254 | 1/1949 | Gallo | D57/1 C |
| D161,850 | 2/1951 | Maier | D57/1 C |
| D186,135 | 9/1959 | Watkins | D57/1 B |
| D229,098 | 11/1973 | Reed | D57/1 C |

*Primary Examiner*—Steven E. Lipman
*Attorney, Agent, or Firm*—Leonard S. Selman

[57] ABSTRACT

A protective case for clip-on sunglasses (clip-ons) including a rigid plastic pouched shaped body having means thereon for preventing damage to the lenses or clip structure of the clip-ons and for maintaining the clip-ons properly positioned in the case to prevent inadvertent slippage or removal thereof.

7 Claims, 4 Drawing Figures

CASE FOR CLIP-ON SUNGLASSES

BACKGROUND OF THE INVENTION

This invention is directed toward a case for clip-on sunglasses, called clip-ons, and which include a pair of lenses and a clip means for attaching the clip-ons to the wearer's eyeglasses. The case is formed of molded rigid plastic and is especially intended to protect the lenses of the clip-ons when they are not in use and stored therein. The scratching and dirtying of such lenses has long been of particular nuisance to the wearer of such clip-ons as there has not heretofore been available an adequate case that can be easily used and carried. Former cases have not been properly designed and constructed so that they are difficult to manipulate the clip-on sunglasses into and out of. Further, presently available cases which are made with collapsible wall portions which may contact the lenses of the clip-ons present the problem of possibly scratching the lenses due to dirt particles, or the like, which may become embedded therein. The rigid case also is intended to protect the clip-means which attach the clip-ons to the wearer's eyeglasses. Thus when the clip-ons are carried in a pocket for example the clip means as well as the lenses are held in a position so that they are protectively enclosed by the rigid case.

OBJECTS AND SUMMARY OF THE INVENTION

Thus it is an object of this invention to provide a case for clip-on sunglasses that is so constructed as to easily receive a pair of the clip-ons therein and will protect the lenses and clip means thereof from harm such as by scratching of the lenses or inadvertent catching of the clip means on foreign objects.

Another object of the invention is to provide a case for clip-on sunglasses which cannot damage the lenses thereof while containing the clip-ons or while the clip-ons are manipulated into or out of the case.

A further object is to provide a case for clip-on sunglasses which prevent inadvertent slippage within or removal of the clip-ons from the case.

A still further object is to provide a case for clip-ons which is simple and inexpensive to manufacture and which in combination with a pair of clip-ons is displayed with the clip-ons held therein and can be sold as a unit to a customer. Other objects of the invention will in part be obvious and will in part appear hereinafter.

Pursuant to the above objects the case for clip-on sunglasses is preferably a one-piece rigid molded plastic container which is shaped like an open-topped rigid walled pouch. Thus the front wall of the case is joined about its bottom and side peripheral portions to the bottom and side peripheral portions of the rear wall thereof. The top peripheral portions of the front and rear case walls form an opening into which the clip-on sunglasses are inserted into the case for storage therein. The front and rear walls have a configuration such that there is adequate space for the clip-ons to be supported therebetween without the viewing surfaces of the lenses of the clip-ons contacting any of the wall surfaces. The clip-ons include a centrally located clip means for attachment to an optical eyeglass frame. The clip-ons are held in their desired position within the case and the lenses positively prevented from contact with the walls of the case by means of the clip means and its engagement with portions of the case structure. In its properly held position the clip means is also protected from damage as it is held in such a position that it is enclosed and protected by the surrounding walls of the protective case.

DESCRIPTION OF THE PREFERRED EMBODIMENT

Figure 1:
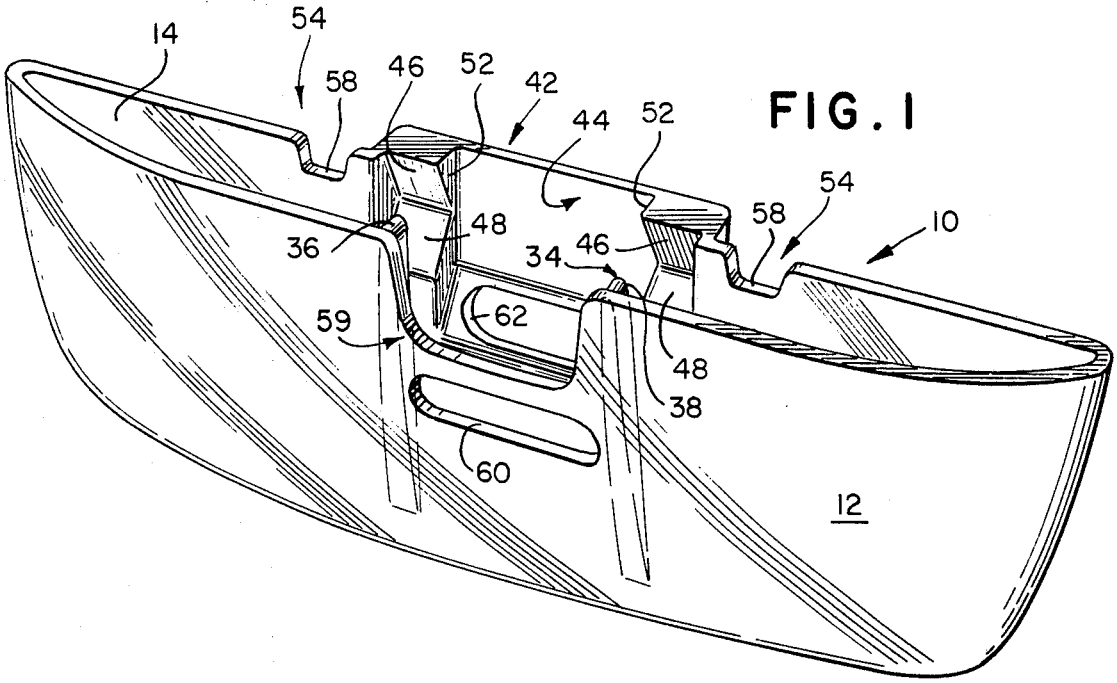
FIG. 1 is a front perspective view of the clip-on sunglass case embodying the invention.

Referring to the drawings, and particularly to FIG. 1 thereof, there is shown a perspective view of the clip-on case 10. The case 10 is essentially an open-topped container pouch-like in shape. It is preferably made of rigid plastic and is molded as a one-piece integral unit. For the purposes of displaying the clip-on sunglasses on a store rack the plastic is preferably transparent so that the goods inside may be viewed by a prospective purchaser.

Figure 2:
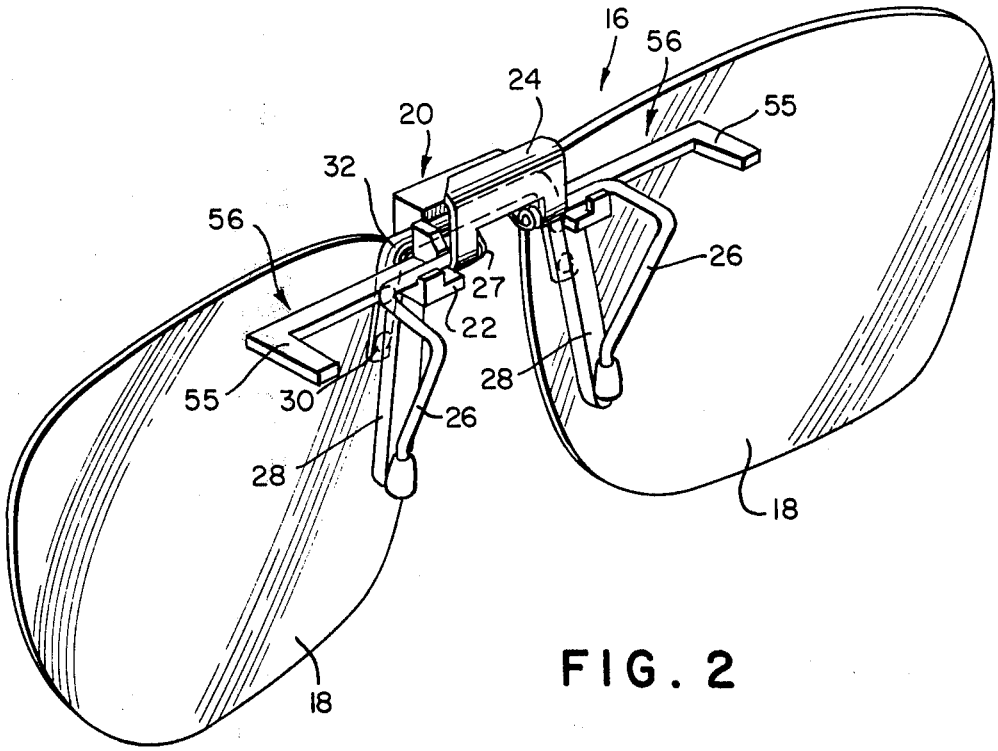
FIG. 2 is a rear perspective view of a pair of clip-on sunglasses which are of the type for which the case of FIG. 1 is meant to contain.

The case 10 includes a front wall portion 12 joined about its periphery to a rear wall portion 14. FIG. 2 of the drawing discloses a pair of clip-on sunglasses 16 for which the case was constructed to fit. These clip-ons are generally similar to those disclosed in U.S. Pat. No. 3,575,497, assigned to the assignee of the present invention. They comprise a pair of lenses 18 attached to centrally located clip means 20. The clip means includes a body portion 22 which supports a spring biased two pronged hand operable clip element 24. The prongs 26 of the clip element are positioned to oppose a pair of fingers 28 extending downwardly from the body portion 22 and are spring biased thereagainst by springs 27. The optical frame to which the clip-ons are attached is clamped between the clip element prongs 26 and the fingers 28 when the clip-on mounted on the frames in use. The clip means further includes two pair of rivits 30 which attach the lenses 18 to a bridge element 32 which is pivotally mounted on body portion 2 providing flip-up and flip-down pivotal movement of the lenses.

Figure 3:
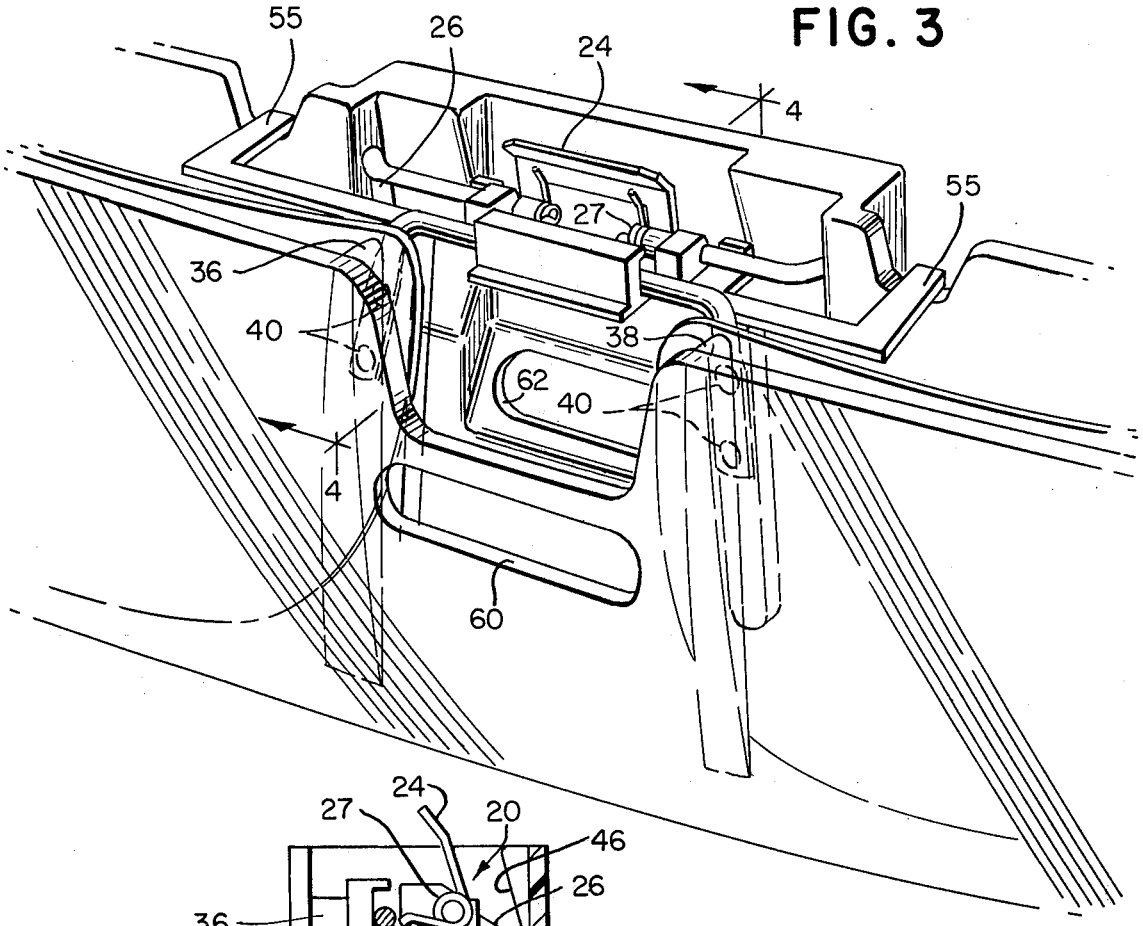
FIG. 3 is an enlarged fragmentary top perspective view of the clip-on sunglasses positioned within the case.
Figure 4:
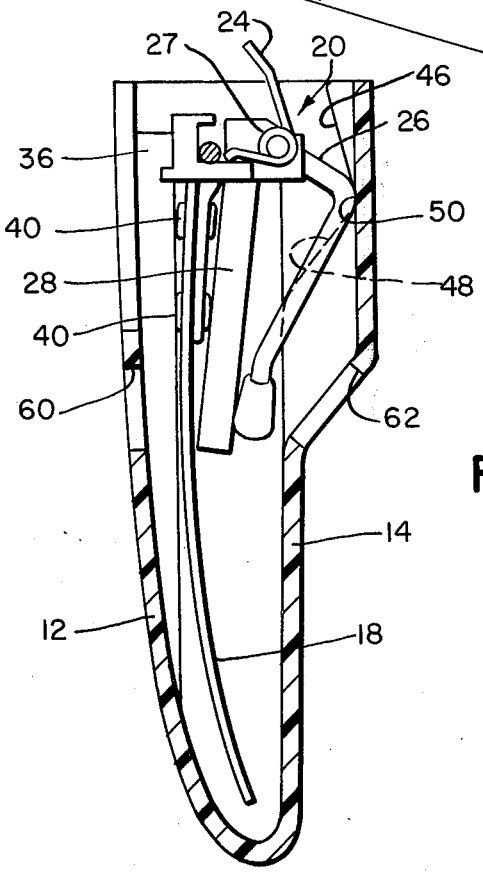
FIG. 4 is sectional view taken along line 4—4 of FIG. 3.

As shown in FIGS. 1, 3 and 4 both the front wall portion 12 and rear wall portion 14 have formed thereon inwardly facing means for engaging the clip means 20. Such means include the rib means 34 which include a pair of ribs 36 and 38 extending inwardly from said front wall portion 12 positioned to engage the heads 40 of rivits 32 which project slightly in front of lenses 18 as shown in FIG. 4. On the rear wall 14, the means for engaging the clip means 20 include an inwardly facing recess 42 in wall 14. As shown in FIG. 3 each of the prongs 26 are engaged by a portion of the rear wall 44 of the recess 22 when the clip-ons are properly positioned in the case 10. Thus the clip-ons are engaged by the rib means 34 and the rear wall 44 of the recess which are spaced apart a predetermined distance such that the clip means 20 is frictionally held therebetween. The rear wall 44 includes two angled wall portions 46 and 48. As shown the portion 46 is angled upwardly toward the center of case 10 while the portion 48 is angled downwardly and inwardly toward the center of the case. The area of contact of the prongs 26 with the rear wall of the recess is in the vicinity of the area of merger 50 between the two angled wall portions. It can be seen that each of the angled wall portions serves to maintain the prongs 26 in the position shown since attempted movement of the prongs either upward or downward on the angled wall surfaces results in a progressive narrowing of the space between the angled wall portions and the rib means thus causing increasing frictional resistance to upward or downward movement. This is especially important in maintaining the clip-on sunglasses is their open-topped case 10 and they will be prevented by angled wall 46 from inadvertent removal therefrom no matter in what position the case may be oriented. By enclosing and maintaining the entire clip-ons within the rigid case it has been made convenient to carry the clip-ons in the users pocket or pocket book. Neither the lenses or clip means can be damaged by rubbing or getting caught on clothing or other items that they may otherwise contact since they are protected by the surrounding walls of the rigid case.

The end walls 52 of the recess 42 serve to restrict lateral movement of the prongs 26 and thus keep the clip-ons properly centered within the case 10. This will insure that the rivit heads 40 will remain in their aligned position to be engaged by ribs 36 and 38.

Further means are provided to provide proper positioning of the clip-on sunglasses in the case 10 in the form of a pair of notches 54 provided in the rear wall of the case. The notches 54 are positioned to receive the end portion 55 of a pair of L-shaped support tabs 56 extending laterally from opposite ends of the clip means body portion 22 as shown in FIG. 2. When the tab end portions 55 contact the bottoms 58 of the notches 54 the clip-ons are restricted from further undesirable downward movement into the case. The tabs 56 serve a similar purpose when the clip-ons are mounted when in use on an optical frame as the end portions 55 thereof then contacting a portion of the frames near the bridge thereof to maintain the clip-ons in proper position thereon.

The large notch 59 formed in the front wall portion 12 between ribs 36 and 38 allows access for the users thumb, for example, when inserting or removing the clip-on sunglasses from the case 10.

The openings 60 and 62 as shown in FIG. 1 in the front and rear walls of the case 10 are provided for the purpose of hanging the case on a store display. A forward projecting member on the display is received through both openings 60,62 and thus a number of such cases with the clip-ons positioned therein may be hung on such a member on the display for easy access by customers. The case and clip-ons inside are ordinarily sold together as a unit to the customers.

Thus an extremely effective carrying case is provided for a pair of clip-on sunglasses which achieves all the objects of the invention as stated.

I claim:

1. A molded rigid plastic case for clip-on sunglasses, said sunglasses including a pair of lenses with front and rear viewing surfaces and a centrally located clip means supporting said lenses for attachment to an optical eyeglass frame, said case comprising:

a substantially pouch shaped one-piece open topped rigid plastic container body for receiving and protectively enclosing the lenses and clip means of the clip-on sunglasses, said body having joined front and rear rigid plastic contoured wall portions such that no portion thereof contacts either the front or rear viewing surfaces of said lenses when said clip-on sunglasses are properly contained in said body;

opposed clip means engaging portions centrally located and inwardly facing on said front and rear wall portions of said body including rib means extending inwardly toward the interior of the case from one of said front and rear wall portions and opposing said rib means on the other of said wall portions, a recess for receiving and engaging a portion of the clip structure, said rib means and recess being spaced apart a distance such as to frictionally hold said clip structure firmly therebetween and serving as a combined means for positively preventing the contact of the front and rear viewing surfaces of the lenses with said front and rear rigid plastic wall portions of said body and to prevent the inadvertent slippage of said clip-on sunglasses from their properly held position in said case.

2. The case for clip-on sunglasses of claim 1 wherein said rib means comprise a pair of inwardly extending laterally spaced ribs for engaging laterally spaced portions of said clip means.

3. The case for clip-on sunglasses of claim 1 wherein said recess includes at least one rear wall portion having an upper and lower portion joined by an area of merger between said wall portions, said upper portion being angled upwardly and inwardly toward the interior of the case from said area of merger and the lower portion being angled downwardly and inwardly toward the interior of the case from said area of merger, whereby said angled upper and lower portions of said rear wall of said recess provide frictional resistance to upward and downward movement of said clip means which is engaged by said recess rear wall in the vicinity of the area of merger of said upper and lower angled walls when said clip-on sunglasses are properly positioned in said case.

4. The case for clip-on sunglasses of claim 3 wherein said recess includes a pair of end walls to restrict lateral movement of the clip means to maintain the clip-on sunglasses properly centered in the case.

5. The case for clip-on sunglasses of claim 3 wherein at least said front wall portion is transparent plastic for viewing of the sunglasses within said case.

6. The case for clip-on sunglasses of claim 5 wherein said entire case is of transparent plastic.

7. In combination;

a pair of clip-on sunglasses, said sunglasses including a pair of lenses, each having front and rear viewing surfaces and a clip means for attachment to an optical eyeglass frame; and a molded rigid plastic case for said clip-on sunglasses, said case comprising;

a substantially pouch shaped one-piece open topped rigid plastic container body for receiving and protectively enclosing the lenses and clip means of the clip-on sunglasses, said body having joined front and rear rigid plastic contoured wall portions such that no portion thereof contacts either the front or rear viewing surfaces of said lenses when said clip-on sunglasses are properly contained in said body;

opposed clip means engaging portions centrally located and inwardly facing on said front and rear wall portions of said body including rib means extending inwardly toward the interior of the case from one of said front and rear wall portions and opposing said rib means on the other of said wall portions, a recess for receiving and engaging a portion of the clip structure, said rib means and recess being spaced apart a distance such as to frictionally hold said clip structure firmly therebetween and serving as a combined means for positively preventing the contact of the front and rear viewing surfaces of the lenses with said front and rear rigid plastic wall portions of said body and to prevent the inadvertent slippage of said clip-on sunglasses from their properly held position in said case.

* * * * *